US007505710B2

(12) United States Patent
Hirai

(10) Patent No.: US 7,505,710 B2
(45) Date of Patent: Mar. 17, 2009

(54) IMAGE FORMING APPARATUS FEATURING PULL-OUT DEVELOPING AND SHEET FEEDING DEVICES

(75) Inventor: Ko Hirai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 11/470,160

(22) Filed: Sep. 5, 2006

(65) Prior Publication Data

US 2007/0059037 A1 Mar. 15, 2007

(30) Foreign Application Priority Data

Sep. 13, 2005 (JP) ..... 2005-264782

(51) Int. Cl.
*G03G 15/04* (2006.01)

(52) U.S. Cl. ..... 399/119

(58) Field of Classification Search ..... 399/107, 399/110, 111, 119, 120, 392
See application file for complete search history.

(56) References Cited

U.S. PATENT DOCUMENTS 5,237,340 A 8/1993 Nelson ..... 346/108
5,848,329 A 12/1998 Aoyama et al. ..... 399/113
7,142,805 B2 * 11/2006 Mizuno et al. ..... 399/392
2006/0291931 A1 * 12/2006 Kobayashi ..... 399/392

FOREIGN PATENT DOCUMENTS

| | | |
|---|---|---|
| JP | 05-080597 | 4/1993 |
| JP | 05-341642 | 12/1993 |
| JP | 07-181753 | 7/1995 |
| JP | 10-078737 | 3/1998 |
| JP | 10-268732 | 10/1998 |
| JP | 2002-072829 | 3/2002 |
| JP | 2002-207408 | 7/2002 |
| JP | 2003-122192 | 4/2003 |

* cited by examiner

*Primary Examiner*—Hoan H Tran
(74) *Attorney, Agent, or Firm*—Fitzpatrick, Cella, Harper & Scinto

(57) ABSTRACT

An image forming apparatus has a developing device and a feeding device. At least a part of the feeding device is supported so that it can be horizontally pulled out by a pulling-out member. The pulling-out member can hold at least a part of the feeding device at a first position away from an image holding member. The feeding device has a supporting member which can support the developing device pulled out toward the first position.

9 Claims, 12 Drawing Sheets

IMAGE FORMING APPARATUS FEATURING PULL-OUT DEVELOPING AND SHEET FEEDING DEVICES

BACKGROUND OF THE INVENTION

1. Field of the Invention

The invention relates to an image forming apparatus for forming an image.

2. Description of the Related Art

Image forming apparatuses of an electrophotographic type have been developed to a digital hybrid apparatus (MFP: multifunction printer) having a plurality of functions or a full-color MFP for overlaying multi-color toner images and simultaneously transferring them owing to such a digitizing process for directly writing electronic information by a laser beam and forming an image. While small and low-cost home-use printers have been widespread, an apparatus for business use which has advanced functions and can cope with the printing of a high speed and a large quantity is also demanded.

In the image forming apparatuses of the electrophotographic type, as well as toner as a developer, a developing unit for supplying the toner onto the surface of a photosensitive drum and developing an electrostatic latent image is also consumable. Therefore, a structure for taking out the developing unit on the assumption that a periodic exchange and maintenance work are executed is provided.

A taking-out structure of a developing unit also serving as a jam process of sheets has been disclosed in Japanese Patent Application Laid-Open No. H05-080597. In such a structure, a casing structure in which a sheet conveying surface is divided into upper and lower portions and can be opened and closed is used, the developing unit is dropped and arranged into the lower portion of the casing structure, and the developing unit can be pulled out upward by rotating upward and opening the upper portion of the casing structure.

A taking-out structure of a developing unit in which a right side surface of an image forming apparatus is opened and the developing unit is taken out in the upper oblique direction has been disclosed in Japanese Patent Application Laid-Open No. H05-341642.

A developing unit in which a knob is attached to an upper surface of the developing unit and the developing unit can be lifted upward has been disclosed in Japanese Patent Application Laid-Open No. H07-181753.

An image forming apparatus in which a developing unit is arranged under a developer storing portion which can supplement a developer to the developing unit has been disclosed in Japanese Patent Application Laid-Open No. 2003-122192. The developing unit can be taken out to a side surface side of the image forming apparatus through a portion under the developer storing portion.

An image forming apparatus in which a slide rail is arranged to thereby enable a developing unit to be horizontally pulled out has been disclosed in Japanese Patent Application Laid-Open No. H10-078737.

In a copying apparatus or a multifunction printer of the electrophotographic type, an image reading apparatus (so called an image scanner) is arranged in an upper portion of an apparatus main body for forming images. Therefore, the constructions in which the casing structure is divided into the upper and lower portions and the developing unit is taken out upward as shown in Japanese Patent Application Laid-Open Nos. H05-080597 and H07-181753 cannot be used. This is because the divided upper portion becomes very large and heavy due to the image reading apparatus and the like and it is extremely unreasonable in terms of the structure, a setting space, and a working space.

In the case of realizing the high-speed and large-quantity printing by providing the developer storing portion over the developing unit as shown in Japanese Patent Application Laid-Open No. 2003-122192, the construction in which the side surface of the image forming apparatus is opened and the developing unit is taken out in the upper oblique direction as shown in Japanese Patent Application Laid-Open No. H05-341642 cannot be used. This is because the large developer storing portion has been arranged in the upper oblique position of the developing unit.

According to the apparatus which can cope with the high-speed and large-quantity printing as shown in Japanese Patent Application Laid-Open No. 2003-122192, since the developing unit has a developing sleeve and an agitating mechanism, it is large and fairly heavy. It is, therefore, difficult for an ordinary person to move the developing unit in the horizontal direction in a groping state while supporting it by hand.

At present, a sales style in which an option apparatus is provided for the apparatus main body with the common specifications in accordance with circumstances of the individual user is a main stream. This is because if the apparatus main body and various kinds of parts are used in common, both of the cost reduction and the improvement of quality and reliability can be accomplished and it is also advantageous for reduction in amount of stocks and shortage of a deadline for delivery. However, if the option apparatus is attached to the side surface of the apparatus main body, an access to the inside of the apparatus including the pull-out of the developing unit becomes inconvenient.

For example, there is a case where a developer supplementing apparatus (152: FIG. 1) is externally attached to an upper portion of the side surface of the apparatus main body in order to cope with a large-quantity continuous process. In such a case, the developer supplementing apparatus becomes an obstacle when the developing unit is pulled out. It is not easy to bypass the developer supplementing apparatus and pull out the developing unit in the groping state while supporting the heavy weight of the developing unit. Each time the user hits the developing unit to an ambient portion, the toner drops out to the surroundings.

There is also a case where a multi-feeding unit (4: FIG. 1) is arranged to the side surface of the image forming apparatus in order to cope with large long sheets or the like which cannot be enclosed in a cassette built in the image forming apparatus, OHP sheets or the like with little opportunity, hard sheets which cannot be conveyed by an ordinary conveying path, sheets which are easily bent and cannot be conveyed by the ordinary conveying path, and the like.

The multi-feeding unit supplies the sheet to the photosensitive drum through a rectilinear short conveying path without using the sheet cassette arranged in a lower portion of the casing structure. However, in such a case, as shown in Japanese Patent Application Laid-Open Nos. 2003-122192 and H10-078737, it is difficult to horizontally take out the developing unit to the side surface of the image forming apparatus. This is because the multi-feeding unit has been arranged at the side position where the developing unit is to be taken out.

SUMMARY OF THE INVENTION

It is an object of the invention to provide an image forming apparatus in which a multi-feeding unit or the like arranged on a side surface of an apparatus main body is used and is made to be actively concerned and cooperated with a pull-out of a developing unit, thereby enabling the pull-out, exchange, attaching, or the like of the developing unit to be easily and certainly performed even in the case of the large and fairly heavy developing unit or the like.

According to the invention, there is provided provide an image forming apparatus comprising: a developing device which develops an electrostatic latent image formed on a surface of an image holding member; a feeding device which feeds a sheet onto which a toner image developed by the developing device is transferred; and a pulling-out member which supports at least a part of the feeding device so that it can be pulled out in the horizontal direction and can hold it at a first position away from the image holding member, wherein the feeding device has a supporting member which can support the developing device pulled out toward the first position.

According to the invention, there is provided provide an image forming apparatus comprising: an apparatus main body; a developing device which is arranged on said apparatus main body and develops an electrostatic latent image formed on a surface of an image holding member; and an arbitrary selecting device arranged on the side opposite to the image holding member so as to sandwich the developing device, wherein a supporting surface of the developing device is formed to the arbitrary selecting device, and the portion in the arbitrary selecting device where the supporting surface has been formed can be moved in the horizontal direction with respect to said apparatus main body in the state where the developing device pulled-out from said apparatus main body has been set.

According to the invention, there is provided a feeding device which can be attached to an apparatus main body of an image forming apparatus having a developing device, comprising: a storing member in which sheets are stored so that they can be taken out; a conveying unit which conveys the sheet taken out of the storing member to the apparatus main body; and a pulling-out member which can be attached to the apparatus main body and supports the conveying member so that it can be moved in parallel, wherein a mounting surface of the developing device is formed on an upper surface of the conveying member.

According to the invention, there is provided provide an image forming apparatus comprising: an apparatus main body; a developing device which is arranged on said apparatus main body and develops an electrostatic latent image formed on a surface of an image holding member and can be pulled out from said apparatus main body; a sheet conveying device which conveys a sheet onto which the image developed by the developing device is transferred; and a supporting member which is provided for the sheet conveying device and supports the developing device pulled-out from said apparatus main body, wherein the sheet conveying device can be moved with respect to said apparatus main body in the pulling-out direction of the developing device.

Further features of the present invention will become apparent from the following description of exemplary embodiments with reference to the attached drawings.

Further features of the present invention will become apparent from the following description of exemplary embodiments with reference to the attached drawings.

DESCRIPTION OF THE EMBODIMENTS

An MFP 100 according to an embodiment of an image forming apparatus of the invention will be described hereinbelow with reference to the drawings. The image forming apparatus of the invention is not limited to the MFP 100 for forming monochromatic images but can be also embodied by a color copying apparatus, a facsimile apparatus, a monochromatic printer, their hybrid apparatus, or the like.

The MFP 100 of the embodiment is not limited to a combination of limited component elements, which will be explained hereinbelow, but can be also embodied by another embodiment obtained by replacing a part or all of them by their alternating members.

Image Forming Apparatus

Figure 1:
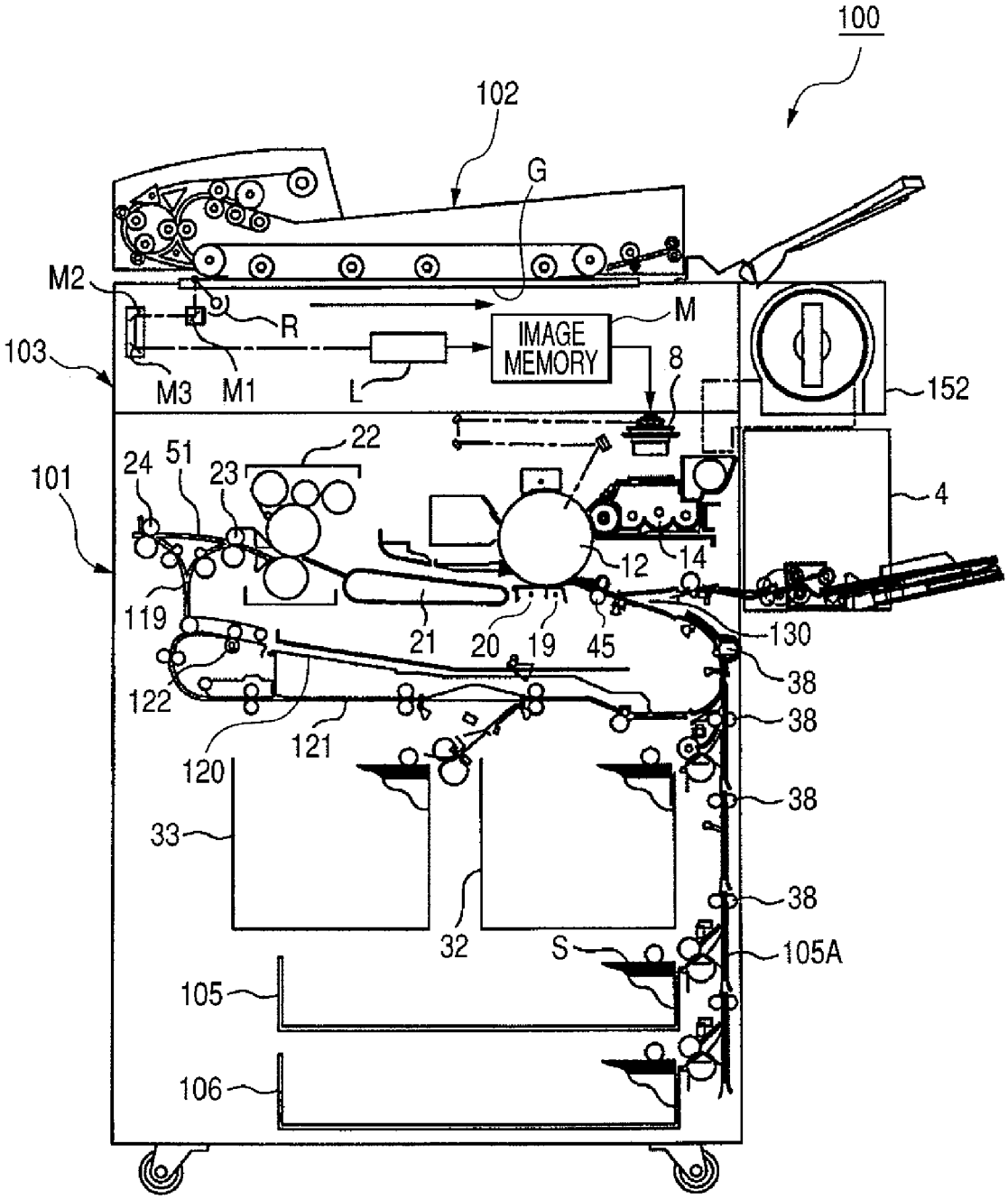
FIG. 1 is an explanatory diagram of a construction of an MFP according to an embodiment.
Figure 2:
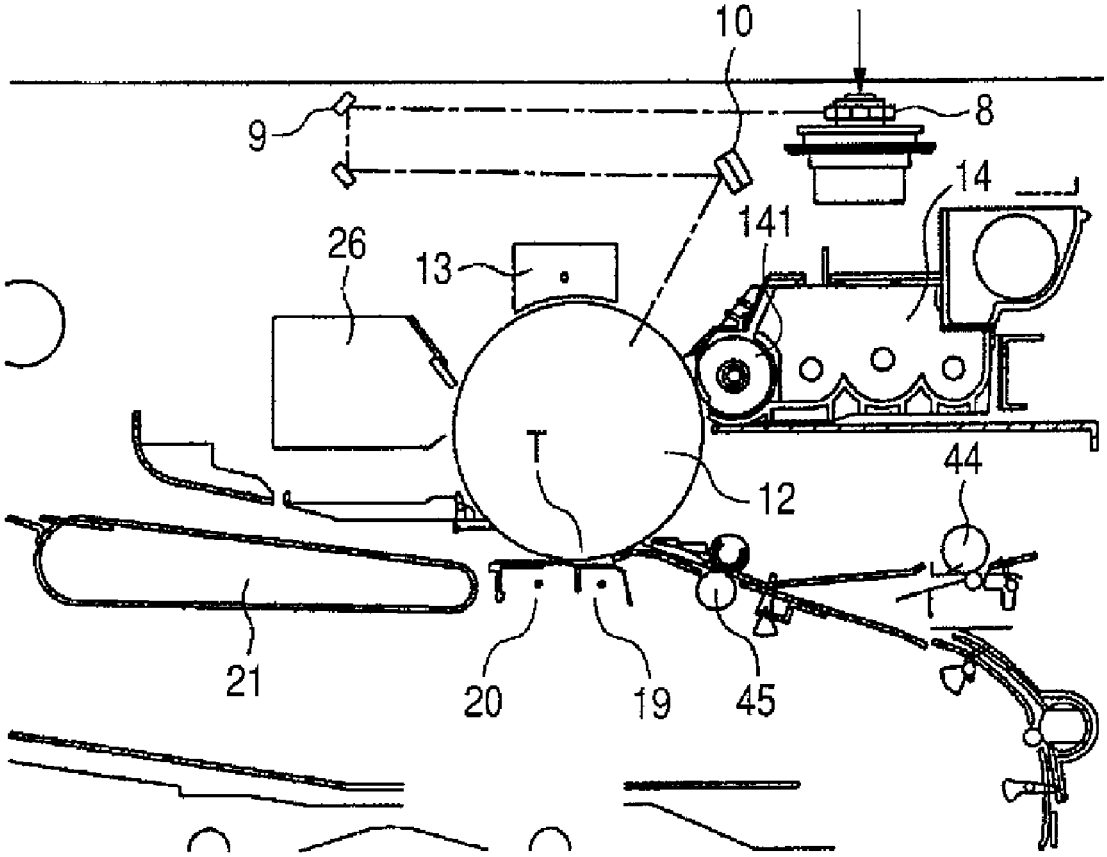
FIG. 2 is an explanatory diagram of a construction of component elements around a photosensitive drum.
Figure 3:
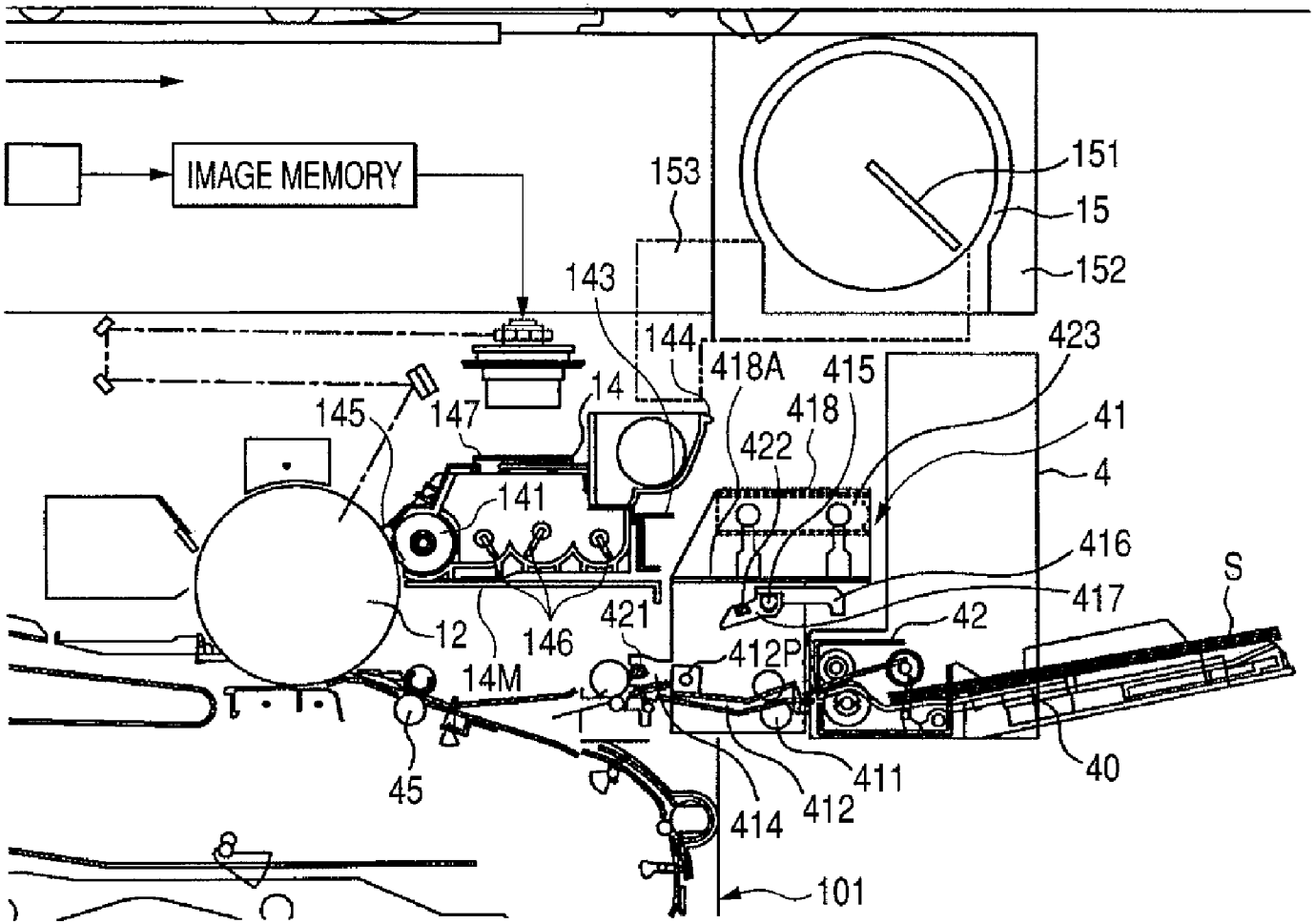
FIG. 3 is an explanatory diagram of a construction of component elements around a developing unit.
Figure 4:
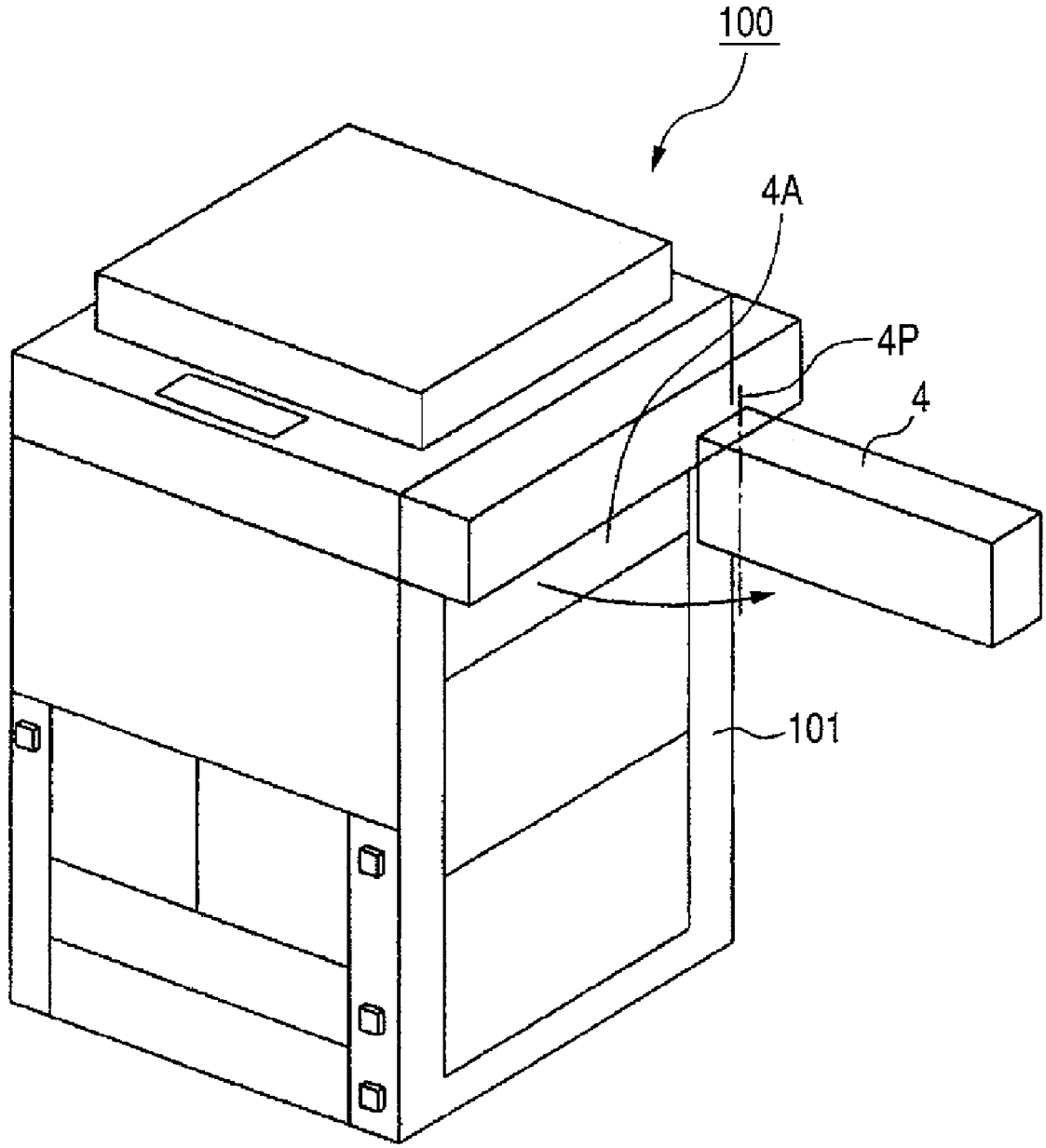
FIG. 4 is an explanatory diagram of a retreat structure of a multi-feeding unit.

FIG. 1 is an explanatory diagram of a construction of the MFP according to the embodiment. FIG. 2 is an explanatory diagram of a construction of component elements around a photosensitive drum. FIG. 3 is an explanatory diagram of a construction of component elements around a developing unit. FIG. 4 is an explanatory diagram of a retreat structure of a multi-feeding unit. The MFP 100 of the embodiment is a monochromatic high-speed MFP.

As shown in FIG. 1, the MFP 100 is constructed by arranging an optical unit 103 onto an apparatus main body 101 for forming images onto sheets and arranging an automatic document feeder (hereinafter, abbreviated as an "ADF") 102 onto the optical unit 103. As arbitrary selecting apparatuses (what are called option apparatuses), a developer supplementing apparatus 152 which stores a large amount of toner and enables an image creation for a long time without supplementing the toner and a multi-feeding apparatus 4 as a feeding apparatus corresponding to a large number of kinds of sheets S are attached to the right side surface of the apparatus main body 101.

The optical unit 103 reads an original fed by the ADF 102 or an original set on an original copyboard glass G and converts it into image data. The ADF 102 separates a bundle of set originals one by one and supplies them onto the original copyboard glass G.

The original set on the original copyboard glass G is illuminated by an illumination R. The illuminated original image is reflected by a plurality of mirrors M1, M2, and M3 and enters a lens L and line images are read by a photoelectric converting device (not shown). By moving the illumination R and the mirror M1 in the direction shown by an arrow and sequentially reading the line images, the image data of the whole surface of the original is formed in an image memory M. After that, the image data of the original is developed into a scan image signal having predetermined timing and a speed synchronized with the rotation of a photosensitive drum 12, and supplied to a laser beam light source (not shown).

A plurality of cassettes 105 and 106 in which a plurality of kinds of sheets S of different sheet sizes have been stored are built in a lower portion of the apparatus main body 101. Stackers 32 and 33 in which a large quantity of sheets S are stored and which correspond to a large-quantity continuous printing are also built in the lower portion of the apparatus main body 101. The sheets S are not limited to paper but, for example, OHP sheets or the like can be also properly selected. For example, the cassette 105 is selected on the basis of sheet size information which has been set through an operating unit (not shown) arranged on an upper surface of the optical unit 103 or information of a sheet size which has automatically been discriminated from the image data of the original. One sheet S conveyed by a feed separating apparatus 105A is conveyed to a resist roller 45 through vertical path conveying units 38 and a pre-registration conveyance guide portion 130 and enters a standby state.

The resist roller 45 conveys the sheet S to an interval between the photosensitive drum 12 and a transfer charging unit 19 synchronously with the rotation of the photosensitive drum 12, thereby allowing a head of a toner image formed on the surface of the photosensitive drum 12 to coincide with a front edge of the sheet S. The transfer charging unit 19 transfers the toner image formed on the surface of the photosensitive drum 12 onto the sheet S. A separation charging unit 20 separates the sheet S onto which the toner image has been transferred from the photosensitive drum 12 and sends it to a conveying unit 21.

The sent sheet S is conveyed to a fixing unit 22 by the conveying unit 21. The fixing unit 22 allows the sheet S onto which the toner image has been transferred to pass through a nip of a pressure contact roller pair of a high temperature and allows a high temperature and a high pressure to act on the sheet S, thereby melt-bonding the toner image into a surface tissue of the sheet S and fixing it.

After that, in the case of a simplex copying mode, the sheet S is sent from an inner delivery roller 23 to an outer delivery roller 24 and ejected as it is to the outside of the apparatus main body 101. However, in the case of a duplex copying mode, a flapper 51 is switched, a re-feed conveying path 119 is opened, and the sheet S is conveyed from the inner delivery roller 23 to a reversing path 120 through the re-feed conveying path 119.

By reversely rotating a reversing roller 122 at a timing when a rear edge of the sheet S has passed through the re-feed conveying path 119 and has been sandwiched by the reversing roller 122, the sheet S is switch-back conveyed and fed to a duplex path 121 in the state where the obverse and reverse surfaces have been reversed and the front and rear sides have been reversed. After that, the sheet S passes through the duplex path 121, passes through the pre-registration conveyance guide portion 130 again, and is conveyed to the resist roller 45. Thereafter, the sheet S is conveyed along a path similar to that in the case of the simplex copying mode and an image is also formed on the back surface. The sheet S is sent from the fixing unit 22 to the inner delivery roller 23 and the outer delivery roller 24 and ejected to the outside of the apparatus main body 101.

As shown in FIG. 2, a primary charging unit 13, a scanning mirror 8, a developing unit 14 as a developing apparatus, a cleaner 26, and the like are arranged around the photosensitive drum 12. The primary charging unit 13 resets the surface of the photosensitive drum into a uniform primary charging state. The scanning mirror 8 scans the laser beam which has been emitted from the laser beam light source mentioned above and obtained by light-modulating the scan image signal, thereby writing an electrostatic latent image onto the surface of the photosensitive drum 12. The cleaner 26 cleans the surface of the photosensitive drum 12 to which the transfer of the toner image has been finished.

The developing unit 14 deposits the toner as a developer onto the surface of the photosensitive drum 12 on which the electrostatic latent image has been formed by using a developing sleeve 141, thereby forming the toner image as a visible image onto the surface of the photosensitive drum 12.

Developing Unit

As shown in FIG. 3, the developing unit 14 is arranged on a developing apparatus base plate 14M fixed to a frame of the apparatus main body 101 and has: a buffer tank 144 made of a resin for storing the toner; and the developing sleeve 141 to hold the toner by a magnetic force of the surface. The developing unit 14 also has: a restricting blade 145 to restrict an amount of toner which is held to the developing sleeve 141; an agitation conveying member 146 to supply the toner to the developing sleeve 141 while stirring the toner; a first knob 143 which is used when the user horizontally pulls out the whole developing unit; a second knob 147 which is used when the user lifts up the whole developing unit; and the like.

The developing sleeve 141 faces the photosensitive drum 12 as an image holding member at a gap of about 200 μm. To assure a gap precision, an abutting roller (not shown) which is come into contact with the photosensitive drum 12 is provided for the developing unit 14 coaxially with the developing sleeve 141.

The toner is supplied to the user in the state where a developer enclosing container 15 made of a resin having an agitation conveying member 151 therein is filled with the toner of about 1700 g. The toner of about 250 g in the stationary state is enclosed in the buffer tank 144 of the developing unit 14.

The user exchanges the empty developer enclosing container 15 attached to the developer supplementing apparatus 152 for a new developer enclosing container 15 on the basis of an exchanging instruction displayed on an operation panel or the like, so that the toner is supplemented to the apparatus main body 101. The toner is conveyed to the buffer tank 144 of the developing unit 14 from the developer supplementing apparatus 152 through a developer conveying path 153 (portion shown by an alternate long and two short dashes line) having a developer conveying member (not shown) therein.

Each of the photosensitive drum 12, developing unit 14, primary charging unit 13, cleaner 26, and the like is attached as a unit so that they can be individually taken out. This is because in the MFP 100, there are the following maintenance items and it is necessary to enable the maintenance work to be easily and certainly performed without an error.

(1) Since the surface layer of the photosensitive drum 12 deteriorates by a slide friction with the developer or sheet S or an aging change, it is necessary to periodically exchange the drum, for example, every one-million print copies in the case of the high-speed MFP.

(2) Since the surface layer of the developing sleeve 141 of the developing unit 14 deteriorates by the slide friction with the developer, or the like, it is necessary to periodically exchange the sleeve, for example, every one-million print copies in the case of the high-speed MFP.

(3) Since the photosensitive drum 12, developing unit 14, primary charging unit 13, and cleaner 26 are always in contact with the developer (including the scattered developer), it is necessary to clean them at an interval shorter than the exchange interval.

In the case of executing those various kinds of maintenance work, it is necessary to move the developing unit 14 for each maintenance work. A destination position where the developing unit 14 is moved is either a position where it is retreated from the photosensitive drum 12 or a position where it has perfectly been pulled out of the apparatus main body 101.

Sheet Material Conveying Apparatus

As shown in FIG. 3, the multi-feeding apparatus 4 corresponding to many kinds of sheets S has been attached to the position of the right side of the apparatus main body 101 where the developing unit 14 arranged is pulled out. The multi-feeding apparatus 4 has: a paper feed tray 40 as a storing portion to stack and hold the sheets S; and a sheet material conveying apparatus 41 assembled so that it can be separated from the paper feed tray 40. The sheet material conveying apparatus 41 as a conveying unit sends the sheet S picked up of the paper feed tray 40 by a sheet feeding unit 42 to the apparatus main body 101.

The sheet material conveying apparatus 41 has a conveying roller pair 411 and a conveying guide 412 as functional parts regarding the sheet material conveyance. The conveying guide 412 can be rotated upward around a rotary axis 412P as a rotational center together with the upper roller of the conveying roller pair 411.

A positioning member 414 is fixed to the frame of the sheet material conveying apparatus 41. The sheet material conveying apparatus 41 is positioned in the height direction for the apparatus main body 101 and attached thereto when the positioning member 414 comes into engagement with an axis 421 supported to the frame of the apparatus main body 101.

A subframe 418 for attaching the sheet material conveying apparatus 41 to a slide rail 423 serving as a pulling portion is provided for the sheet material conveying apparatus 41. The sheet material conveying apparatus 41 is moved in the horizontal direction by the slide rail 423 integratedly with the subframe 418.

A hook 417 is urged clockwise in the diagram and supported to the sheet material conveying apparatus 41 through a rotary axis 415. When the hook 417 comes into engagement with a pin 422 fixed to the apparatus main body 101, the positioning of the sheet material conveying apparatus 41 in the horizontal direction is performed.

The subframe 418 has been bent in an upward U-shape when it is seen from the side. A slide surface 418A as a flat supporting portion on the upper side of the bending portion is used as a guide surface to move the developing apparatus 14 or as a table surface on which the developing apparatus 14 is mounted.

The multi-feeding apparatus 4 has the paper feed tray 40 and the sheet feeding unit 42. As shown in FIG. 4, by rotating the multi-feeding apparatus 4 around a rotational center 4P as a center, this side is opened, thereby enabling a moving space of the sheet material conveying apparatus 41 which is subsequently operated to be assured in an open space 4A.

Jam Process

Figure 5:
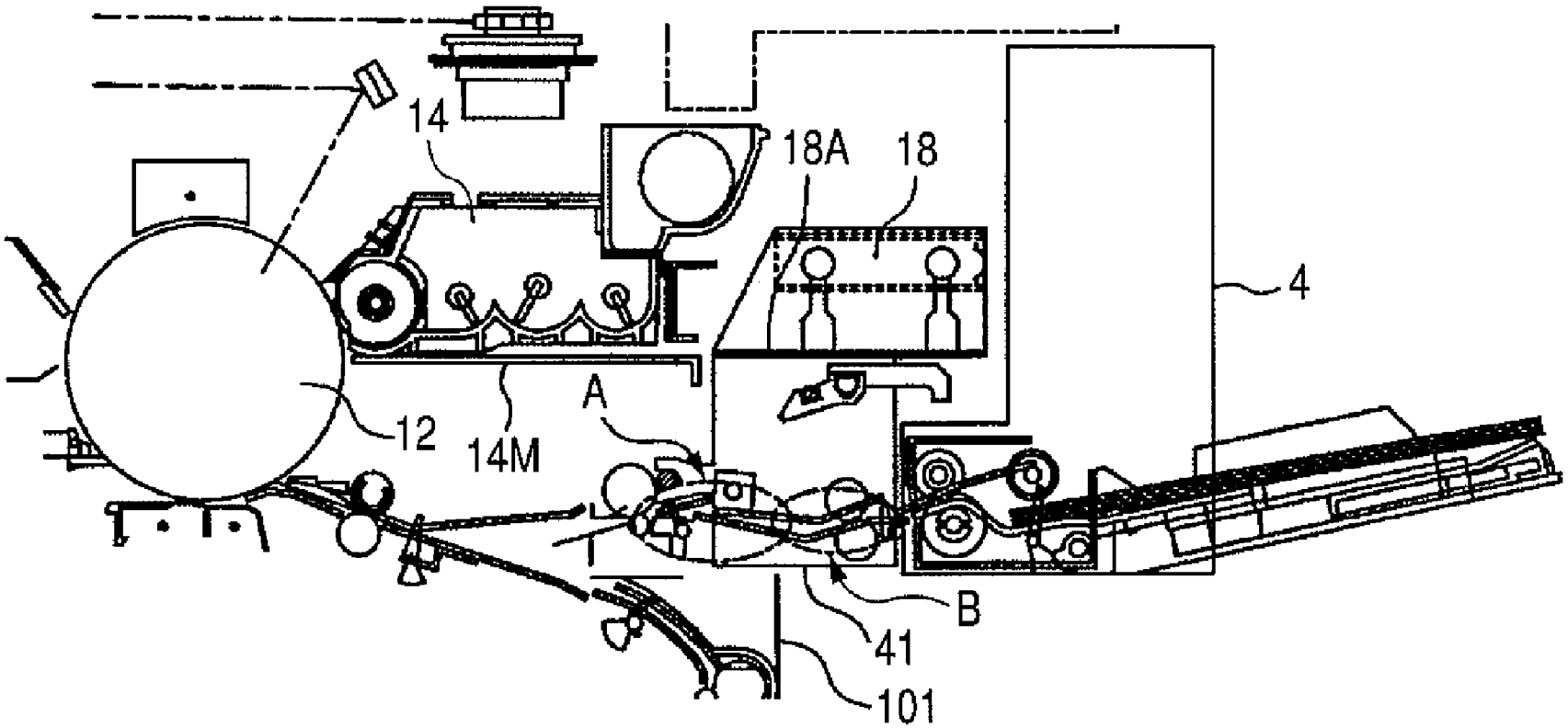
FIG. 5 is an explanatory diagram of a jam position of sheets.
Figure 6:
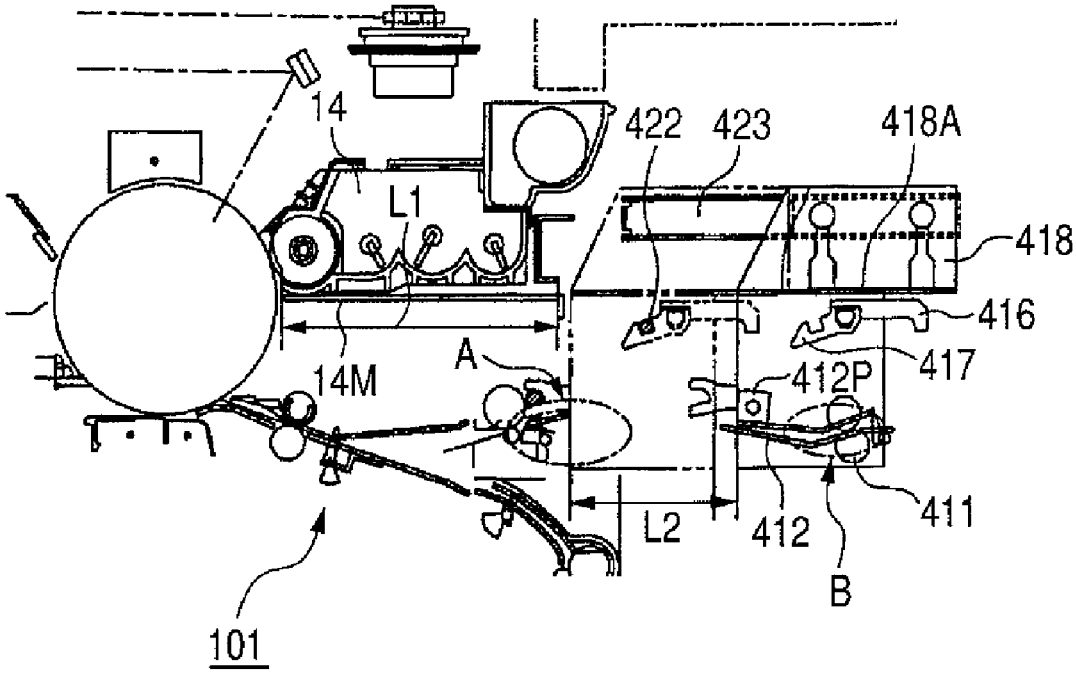
FIG. 6 is an explanatory diagram of the state where a sheet material conveying apparatus has been pulled out.
Figure 7:
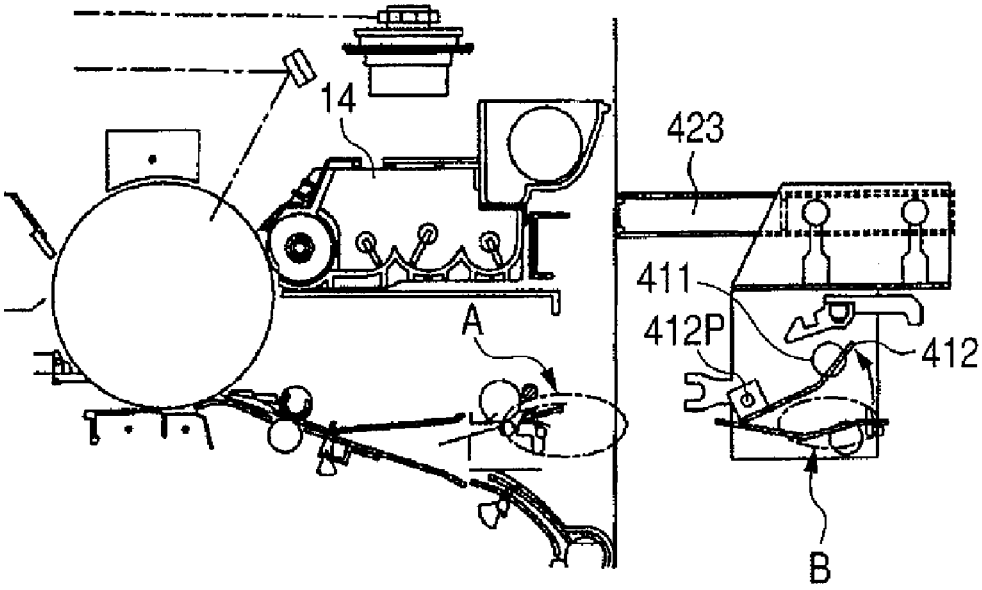
FIG. 7 is an explanatory diagram of a jam process.

FIG. 5 is an explanatory diagram of a jam position of the sheets. FIG. 6 is an explanatory diagram of the state where the sheet material conveying apparatus has been pulled out. FIG. 7 is an explanatory diagram of a jam process. An operating procedure for the jam process of the sheets S in the sheet material conveying apparatus 41 will now be described with reference to FIGS. 5 to 7.

As shown in FIG. 5, jam stop positions of the sheets S which are presumed are positions A and B in the diagram where a rear edge of the sheet S is located. First, as shown in FIG. 4, the operator (user) who executes the jam process retreats the multi-feeding apparatus 4, thereby assuring the pulling space of the sheet material conveying apparatus 41. As shown in FIG. 6, a knob 416 of the sheet material conveying apparatus 41 is rotated upward, thereby releasing the engagement between the hook 417 and the pin 422. The knob 416 is pulled as it is, thereby pulling out the sheet material conveying apparatus 41 to the outside from the apparatus main body 101 by a distance L2. The distance L2 is restricted by a stretch amount of the slide rail 423 and set so as to satisfy a relation of L1>L2 when it is assumed that a length in the pulling-out direction of the developing unit 14 is equal to L1. In this manner, the jammed sheet S existing at the position A in the diagram can be taken out in the state where the sheet material conveying apparatus 41 has been pulled out by the distance L2.

Subsequently, by rotating upward the upper side of the conveying guide 412 around the rotary axis 412P as a rotational center, as shown in FIG. 7, the conveying roller pair 411 is opened in the vertical direction and the sheet S existing at the position B in the diagram can be taken out.

Pull-Out of the Developing Unit

Figure 8:
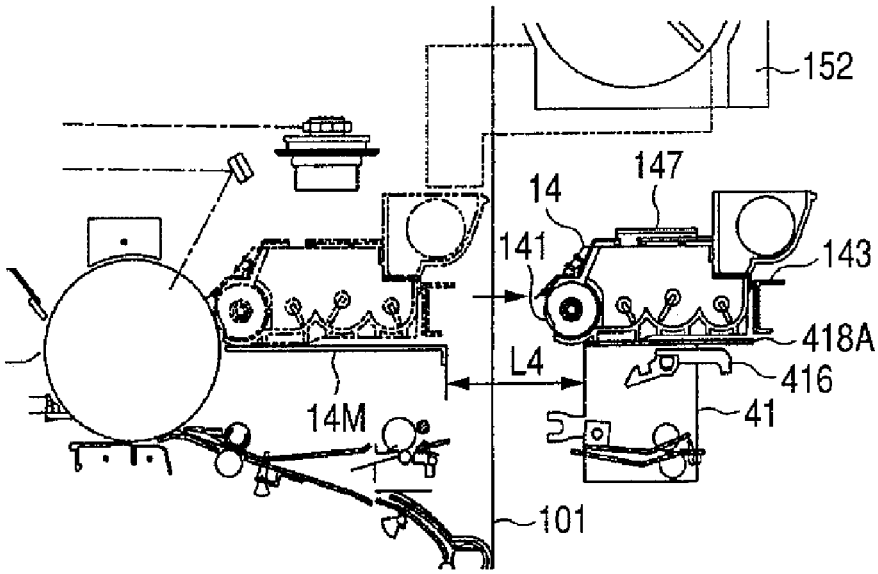
FIG. 8 is an explanatory diagram of a pulling-out mechanism of the developing unit.
Figure 9:
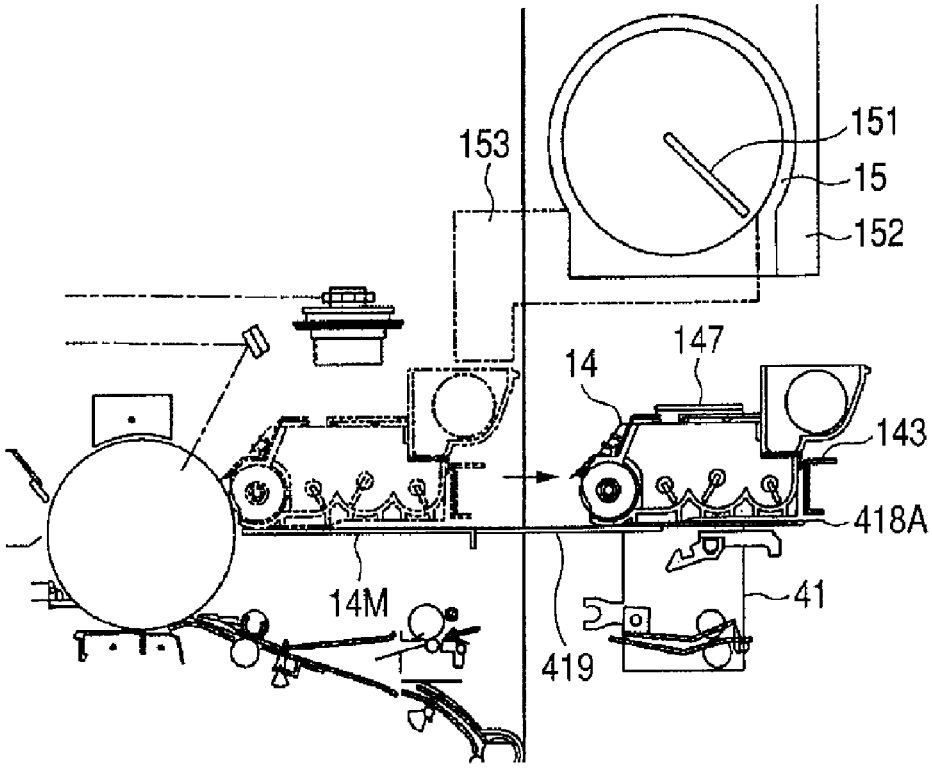
FIG. 9 is an explanatory diagram of a scattering preventing mechanism of a developer.

FIG. 8 is an explanatory diagram of a pulling-out mechanism of the developing unit. FIG. 9 is an explanatory diagram of a scattering preventing mechanism of the developer. A moving mechanism of the developing unit provided for the sheet material conveying apparatus 41 will now be described. Prior to executing the operation to clean or exchange the peripheral parts of the photosensitive drum 12, the developing unit 14 is moved to the position where it has been retreated from the photosensitive drum 12 or the outside position of the apparatus main body 101.

First, the operation in the case of executing the jam process in the sheet material conveying apparatus 41 will be executed. As shown in FIG. 6, a pull-out amount of the sheet material conveying apparatus 41 at this time is equal to the distance L2. As shown in FIG. 8, a distance L4 between the developing apparatus base plate 14M and the slide surface 418A when the sheet material conveying apparatus 41 has been pulled out by the distance L2 is set so as to satisfy a relation of L1>L4 when it is assumed that the length in the pulling-out direction of the developing unit 14 is equal to L1.

Subsequently, the operator grasps the first knob 143 of the developing unit 14 and slides it in the outer direction of the apparatus main body 101. At this time, since there is the relation of L1>L4, before the portion of the developing unit 14 on the side (left side in the diagram) of the photosensitive drum 12 falls off from the developing apparatus base plate 14M, the portion of the developing unit 14 on the pulling-out direction side reaches the slide surface 418A of the sheet material conveying apparatus 41. Therefore, since it is unnecessary for the operator to support a moment due to the tare weight of the developing unit 14 which acts around the first knob 143 as a rotational center, he can easily pull out the developing unit 14 and, thereafter, insert it again.

In this instance, it is possible to prevent such a situation that the operator hits the developing sleeve 141 or an abutting roller (not shown) or the like to the developing apparatus base plate 14M and destroys it. The developing unit 14 is pulled out to a position having a space where the operator inserts his hand to the front rear side or the upper side of the developing unit 14. After that, in the case of perfectly removing the developing unit 14 from the apparatus main body 101, since it is sufficient that he grasps and lifts up the second knob 147 provided almost just over the center of gravity of the developing unit 14, the developing unit 14 can be easily removed.

It is also possible to construct in such a manner that the first knob 143 is pulled in the state before the sheet material conveying apparatus 41 is pulled out, the developing unit 14 is moved from the developing apparatus base plate 14M and put onto the slide surface 418A, the knob 416 is operated in this state, and the sheet material conveying apparatus 41 is pulled out to the outside of the apparatus main body 101 while the developing unit 14 has been mounted.

The slide surface 418A formed on the subframe 418 of the sheet material conveying apparatus 41 is used as a table for mounting the developing unit 14, so that the workability of the maintenance of the developing unit 14 can be improved and the breakdown of the developing unit 14 can be prevented by the simple construction.

As shown in FIG. 9, a slide table 419 as developer drop preventing means which is expanded and contracted in accordance with the pull-out of the sheet material conveying apparatus 41 can be provided for the developing apparatus base plate 14M. The slide table 419 can be also provided for the sheet material conveying apparatus 41 side. By closing a space between the slide surface 418A and the developing apparatus base plate 14M by the slide table 419, the developer which falls from the developing unit 14 in association with the pulling-out operation of the developing unit 14 can be certainly captured. Thus, the dirt in the apparatus main body 101 and the dirt around the MFP 100 can be certainly prevented.

The slide surface 418A is not set to a simple flat surface but a plurality of rollers which come into contact with the bottom surface of the developing unit 14 can be also arranged. As compared with the case of sliding the developing unit 14, a pulling-out resistance of the developing unit 14 is reduced and a pulling-out operability can be further improved.

Another Embodiment

Figure 10:
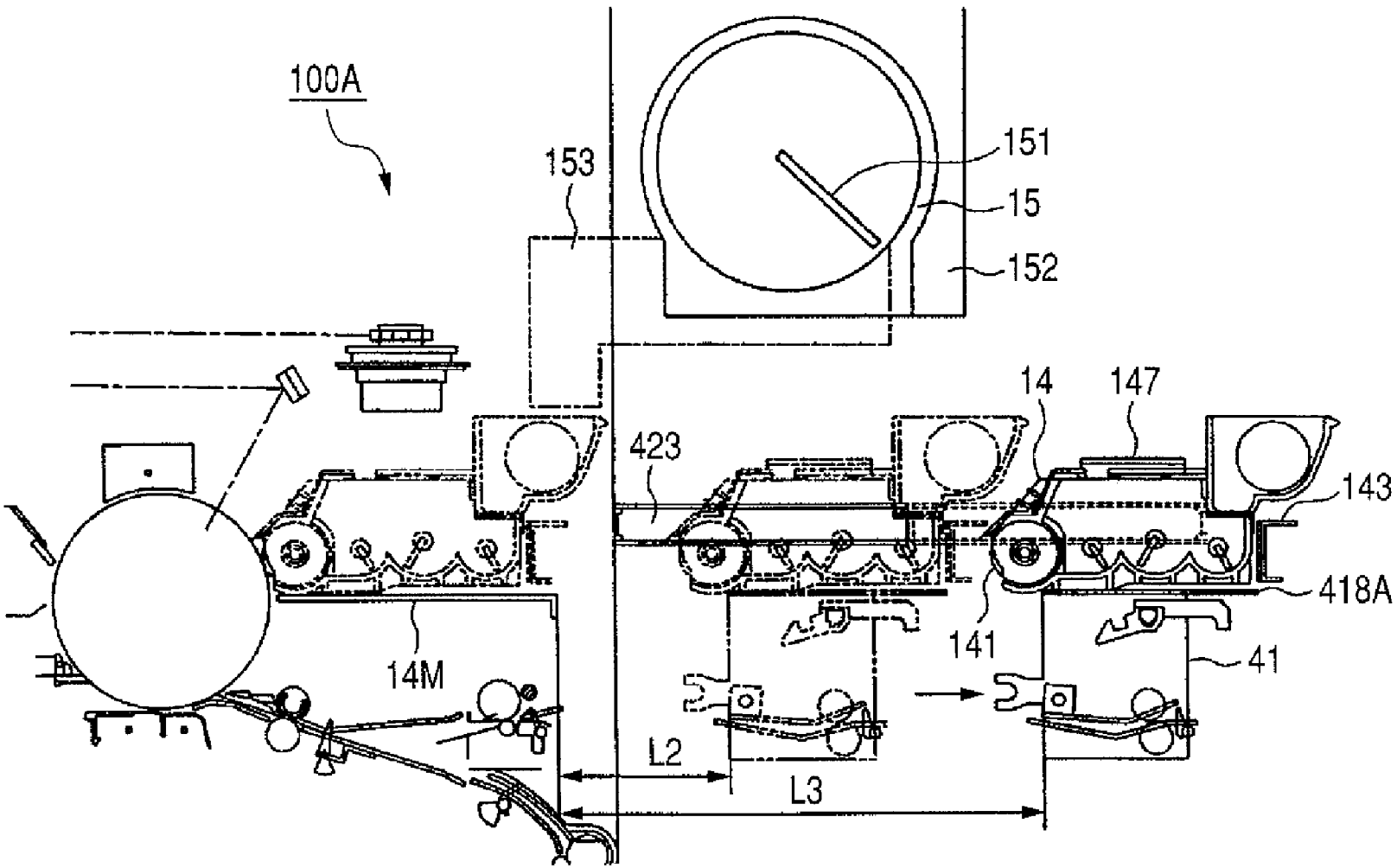
FIG. 10 is an explanatory diagram of a construction of component elements around a developing unit of an MFP according to another embodiment.

FIG. 10 is an explanatory diagram of a construction of component elements around a developing unit of an MFP according to another embodiment. An MFP 100A according to another embodiment is constructed in substantially the same manner as the MFP 100 of the foregoing embodiment described with reference to FIGS. 1 to 9 except that a pulling-out stroke of the sheet material conveying apparatus 41 differs. Therefore, in FIG. 10, the component elements similar to those in FIGS. 1 to 9 are designated by the same reference numerals and their detailed explanation is omitted.

As shown in FIG. 10, in the MFP 100A according to another embodiment, a stroke of the slide rail 423 is set to a large value, thereby enabling the sheet material conveying apparatus 41 to be pulled out to an outside position of the developer supplementing apparatus 152. The pull-out amount of the sheet material conveying apparatus 41 at the time of the jam process is equal to the same distance L2 as that in the case of the embodiment shown in FIG. 6. A different point is that, subsequently, the developing unit 14 is moved onto the slide surface 418A of the sheet material conveying apparatus 41 and, thereafter, the sheet material conveying apparatus 41 is further pulled out up to a distance L3. It is possible to access the upper side of the developing unit 14 and both of the inner/outer sides of the apparatus main body 101. That is, the present embodiment differs from the foregoing embodiment with respect to a point that the sheet material conveying apparatus 41 can be pulled out to the position where the maintenance of the developing unit 14 can be performed.

As mentioned above, by pulling out the developing unit 14 to the distance L3, there is no need to prepare another placing position for mounting the developing unit 14 taken out of the MFP 100A. In the case of taking out the developing unit 14 from the apparatus main body 101 and setting it to another position, it is necessary to pay sufficient attention so that the developing sleeve 141 and the abutting roller are not damaged and the developer which falls from the developing unit 14 does not make the component elements around the apparatus dirty. In the MFP 100A of another embodiment, since the developing unit 14 is not taken down from the sheet material conveying apparatus 41, the occurrence of the problems mentioned above can be easily prevented.

MFP of Comparison

Hitherto, the electrophotographic type has widely been used as an image forming method of forming images onto a transfer material such as a sheet or the like. As a general method of such a method, an electric latent image is formed by charging and exposing a photosensitive material using an electroconductive substance and the latent image is developed by a colored developer and visualized. The toner image developed on the photosensitive material is electrically attracted by a corona discharge or a bias applying member such as an elastic roller or the like from the back side of the transfer material conveyed at predetermined timing. After that, the transfer material is peeled off from the surface of the photosensitive material by a curvature of the photosensitive material and a charge removing member provided near the transfer bias applying member and conveyed to the conveying path. Further, the transfer material is conveyed to a fixing apparatus and heated and pressed every transfer material, the toner is melt-bonded and the fixed image is obtained.

Figure 11:
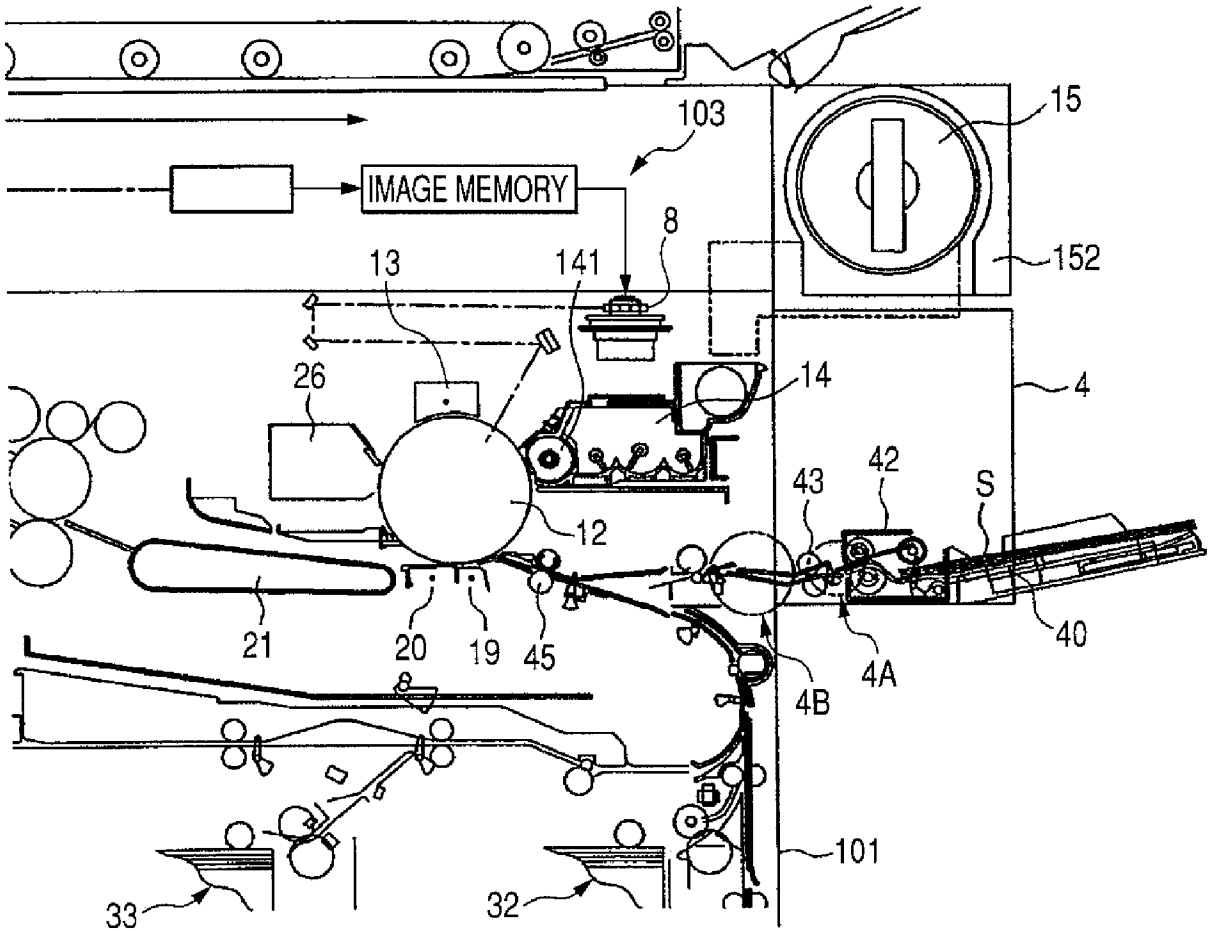
FIG. 11 is an explanatory diagram of a construction of component elements around a developing unit of an MFP according to Comparison.
Figure 12:
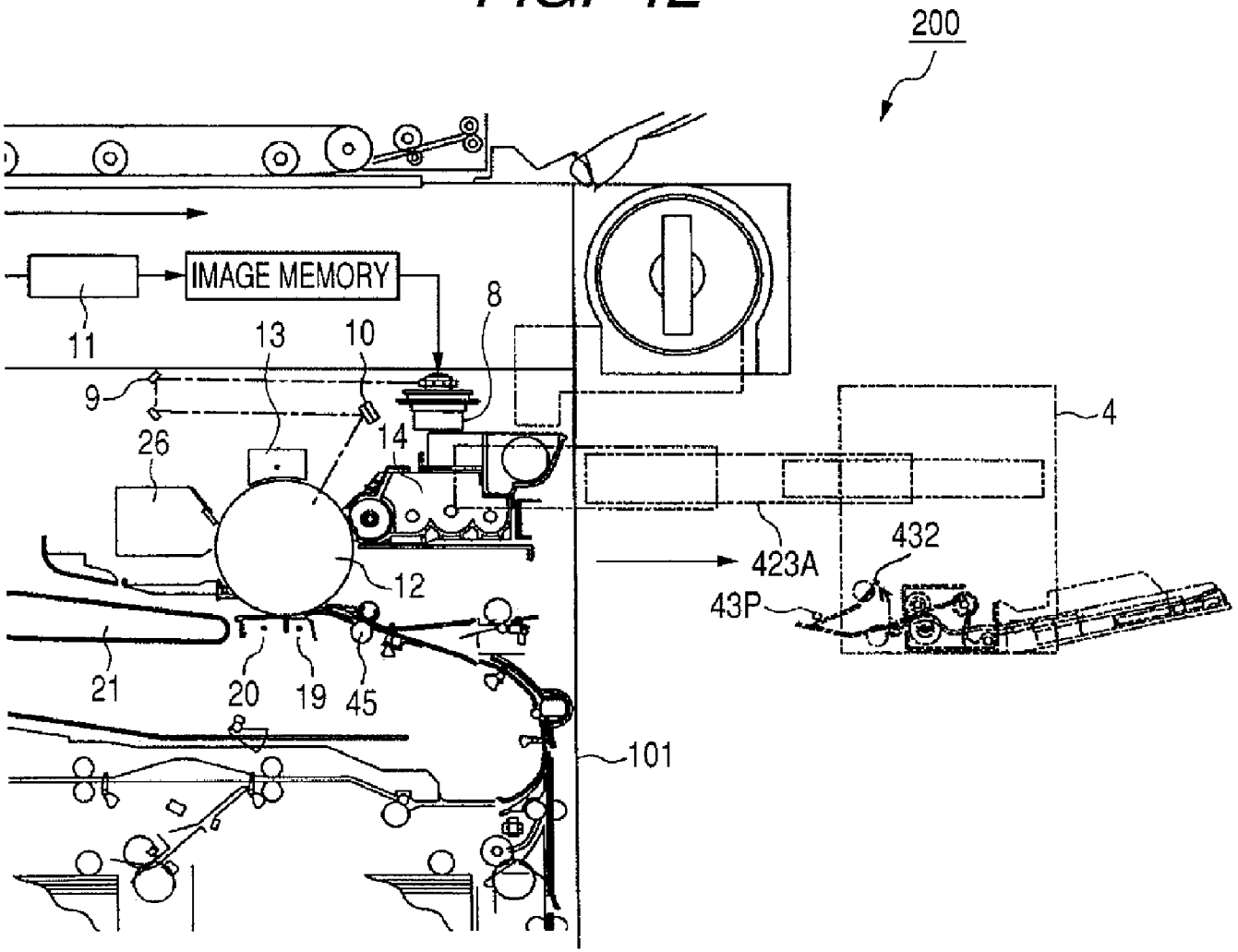
FIG. 12 is an explanatory diagram of a retreat structure of a multi-feeding apparatus.
Figure 13:
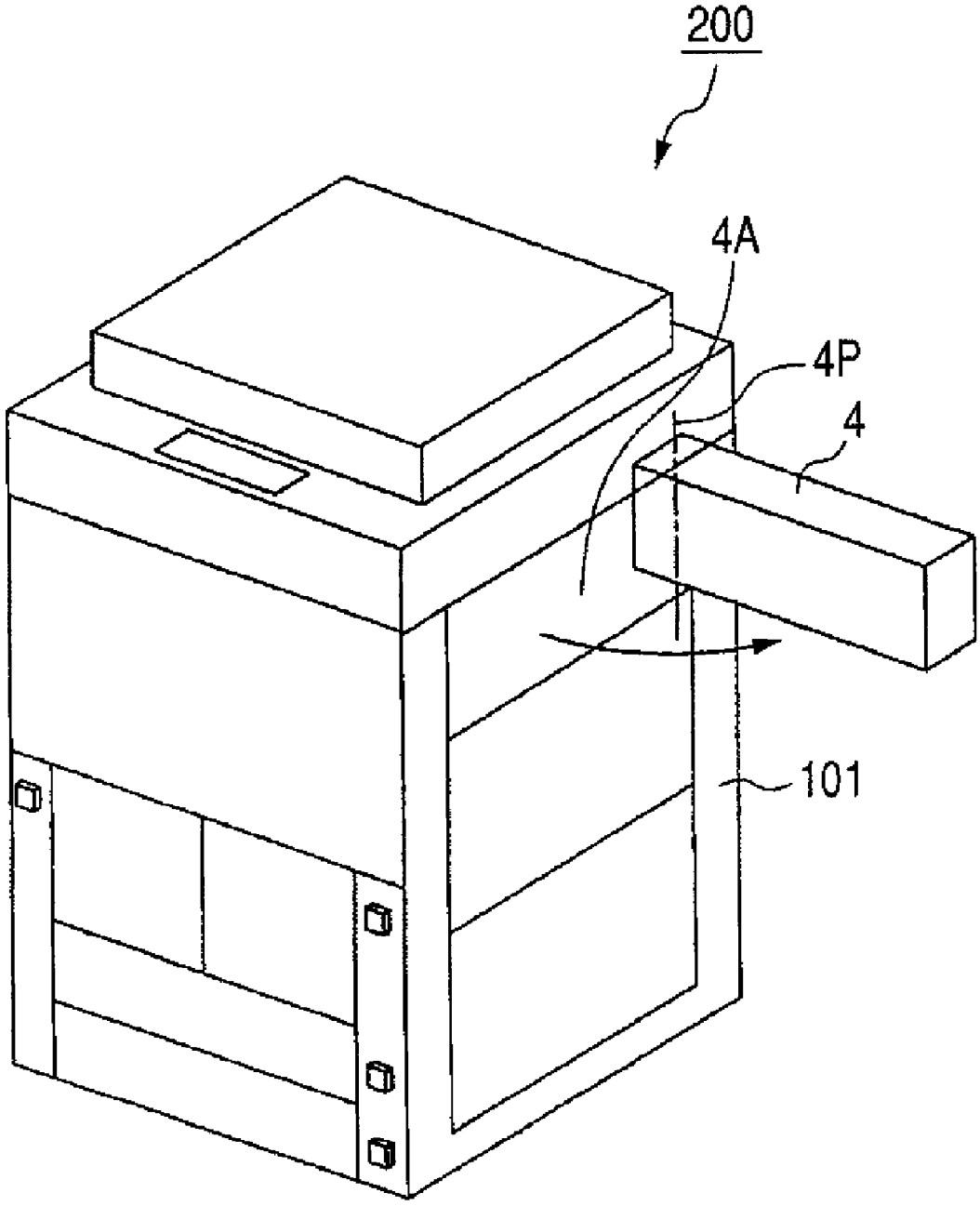
FIG. 13 is an explanatory diagram of another retreat structure of the multi-feeding apparatus.
Figure 14:
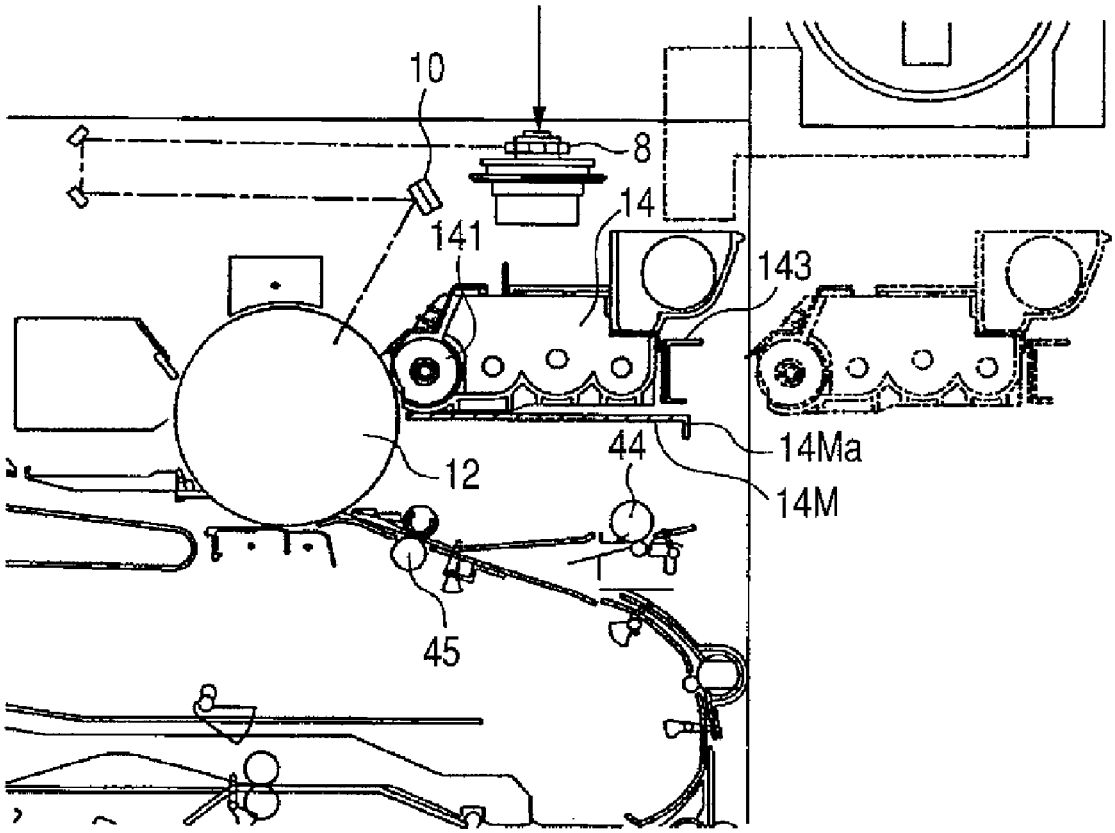
FIG. 14 is an explanatory diagram of an operation to take out the developing unit.

FIG. 11 is an explanatory diagram of a construction of component elements around a developing unit of an MFP according to Comparison. FIG. 12 is an explanatory diagram of a retreat structure of a multi-feeding unit. FIG. 13 is an explanatory diagram of another retreat structure of a multi-feeding unit. FIG. 14 is an explanatory diagram of work for taking out the developing unit. An MFP 200 of Comparison shown in FIGS. 11 to 14 is constructed in substantially the same manner as that of the MFP 100 of the foregoing embodiment described with reference to FIGS. 1 to 9 except for the retreat structure of the multi-feeding apparatus 4. Therefore, in FIGS. 11 to 14, the component elements similar to those in FIGS. 1 to 9 are designated by the same reference numerals and their detailed explanation is omitted.

As shown in FIG. 11, in the multi-feeding apparatus 4, since a conveying path to a facing portion T between the photosensitive drum 12 and the transfer charging unit 19 is rectilinear and almost horizontal as compared with that of the stackers 32 and 33 as paper feeding apparatuses provided in the lower portion, sheet conveying performance is relatively excellent. Therefore, a special sheet S, for example, a sheet material of 265 g/m$^2$ or the like which cannot be conveyed from the stackers 32 and 33 can be conveyed. However, in accordance with various circumstances such as case of a sheet S whose conveying performance is extremely bad or a bent sheet S, case where each roller has already been deteriorated, and the like, there is a possibility that a clogging (jam) of the sheet S occurs in the state where the rear edge of the sheet is stopped in a region 4A or 4B shown by an alternate long and two short dashes line in FIG. 11.

For example, as shown in FIG. 12, the whole multi-feeding apparatus 4 is constructed so as to be horizontally slidable in the direction shown by an arrow by a slide rail 423A. In this case, by sliding the multi-feeding apparatus 4 and assuring a gap between the multi-feeding apparatus 4 and the apparatus main body 101, the jammed sheet in the region 4B in FIG. 11 can be taken out. By upwardly rotating an upper side of a sheet material conveying guide 432 around a rotational center 43P as a center, the jammed sheet in the region 4B in FIG. 11 can be taken out.

For example, as shown in FIG. 13, the multi-feeding apparatus 4 is attached so that this side (front side) can be opened around the rotational center axis 4P on the rear side as a center. In this case, by rearwardly rotating the multi-feeding apparatus 4, a space to remove the jammed sheet as shown in FIG. 12 can be assured.

As a construction to take out the developing unit from the apparatus main body as mentioned above, there is the construction in which the sheet conveying surface is vertically opened and the developing unit is upwardly taken out as shown in JP-A-H05-080597 or the construction in which the developing unit is taken out in the upper oblique direction from the side of the apparatus main body as shown in Japanese Patent Application Laid-Open No. H05-341642. However, in the cases of those constructions, if it is intended to apply them to the MFP 200 of Comparison, there are the following problems as a moving method of the developing unit.

According to Japanese Patent Application Laid-Open No. H05-080597, in order to make the taking-out operation of the developing unit easy, the apparatus main body is formed as a frame structure in which it is vertically opened around the developing unit and the developing unit is provided on the lower frame side as a boundary. According to such a structure, as shown in FIG. 11, in the MFP 200 of Comparison in which the developer supplementing apparatus 152, scanning mirror 8, and optical unit 103 are provided over the developing unit 14, all or a part of those units have to be temporarily slid in the lateral direction, so that a complication of the construction and an increase in costs are caused.

According to Japanese Patent Application H05-341642, the developing unit exists only at either the position at the time of the image creation or the position where it has completely been removed from the apparatus main body. Therefore, there is a possibility that in the state where the developing unit 14 has been removed, the developing sleeve 141 is exposed, the sleeve surface is scratched, or the hand or clothing of the operator is made dirty. To prevent such a problem, a construction in which a shutter member which is interlocked with the pulling-out operation of the developing unit 14 is provided lest the developing sleeve 141 is exposed is used. However, the construction of the developing unit 14 becomes complicated.

According to Japanese Patent Application Laid-Open No. 2003-122192, as shown in FIG. 11, when the developing unit 14 is taken out, the spaces for the operator to insert his hand do not exist over and under the developing unit 14. Therefore, as shown in FIG. 7, he has to grasp the first knob 143 provided in the outside in the moving direction of the developing unit 14 and pull out the developing unit 14. Particularly, as for the developing unit in the high-speed MFP, since a volume of the developer is large and the respective parts have been designed so as to have a high rigidity in order to accomplish a long service life, there is such a tendency that the developing unit becomes a heavy unit. Consequently, the moment due to the tare weight of the unit which acts around the first knob 143 as a rotational center increases and the pulling-out work becomes difficult. If the user pulls out the developing unit without paying careful attention, when he has pulled out the developing unit 14 to the position shown by an alternate long and two short dashes line in FIG. 7, the unit falls off from the developing apparatus base plate 14M.

When the developing unit is inserted, the developing sleeve 141 or a positioning roller (not shown) to assure a gap between the developing sleeve 141 and the surface of the photosensitive drum 12 are damaged by a wall 14Ma on the inserting side of the developing apparatus base plate 14M. If the shutter member is provided to prevent such a situation, a complication of the construction and an increase in costs are caused.

According to Japanese Patent Application Laid-Open No. H10-078737, the slide rail to take out the developing unit is provided. Although the workability of the operation to take out the developing unit is fairly improved according to the slide rail such a structure, a frame member to couple the slide rail with the developing unit is necessary and it is necessary to assure a space for such a frame member. An enlargement in size of the machine and an increase in costs are caused.

In the image forming apparatus having the developing unit 14 for developing the electrostatic latent image formed on the surface of the photosensitive drum 12 and the multi-feeding apparatus 4 which is arranged adjacent to the developing unit 14 and feeds the sheet S to the photosensitive drum 12, the MFP 100 of the embodiment has the slide rail 423 for horizontally pulling out the sheet material conveying apparatus 41 and holding it at the position that is away from the photosensitive drum 12 by the distance L2.

The slide surface 418A which can support the developing unit 14 pulled out toward the position of the distance L2 is formed on the sheet material conveying apparatus 41. Therefore, the sheet material conveying apparatus 41 which is movable so that the jammed sheet can be taken out is used in common for the pulling-out conveyance of the developing unit 14, further, the temporary storage at the retreat position, and the working table, so that the members and mechanisms which are exclusively used for the pulling-out of the developing unit 14, the supporting, and the storage are unnecessary.

In other words, the sheet material conveying apparatus 41 which inherently becomes an obstacle to the operation for handling or pulling out the developing unit 14 is designed to a structure suitable for supporting the developing unit 14 in such a manner that it is actively concerned and cooperated with the pulling-out work of the developing unit 14. Therefore, on the contrary, the developing unit 14 can be further easily pulled out and stored as compared with the case where there is no sheet material conveying apparatus 41.

Consequently, it is sufficient that the physical strength, experience, knowledge, and skill necessary to pull out the developing unit 14 are small. Such a situation that the developing unit 14 is hit to the ambient portions and the toner is scattered does not occur. The exchange of the parts and the necessary maintenance work can be executed safely, certainly, and cleanly.

According to the MFP 100 of the embodiment, the multi-feeding apparatus 4 has: the paper feed tray 40 on which the sheets S are stored so that they can be taken out; and the sheet material conveying apparatus 41 which is assembled so that it can be separated from the paper feed tray 40, conveys the sheet S picked up from the paper feed tray 40, and sends it to the photosensitive drum 12. The slide rail 423 supports the sheet material conveying apparatus 41 so that it can be retreated to the position of a distance L. The paper feed tray 40 is retreated to the further outside than the sheet material conveying apparatus 41 which has been retreated to the position of the distance L, and a working space can be formed between the paper feed tray 40 and the sheet material conveying apparatus 41. Therefore, the developing unit 14 can be put to the sheet material conveying apparatus 41 of the necessary minimum size. The ordinary maintenance work such as removal of the jammed sheet, cleaning of the developing unit 14, and the like can be executed without being obstructed by the large paper feed tray 40.

According to the MFP 100 of the embodiment, the slide surface 418A can support the developing unit 14 which has almost horizontally been moved from the attaching position of the developing unit 14 and has been sent to the slide surface 418A. The length L1 in the pulling-out direction of the developing unit 14 is larger than the width L4 of the gap which is formed between the attaching position of the developing unit 14 and the slide surface 418A when the multi-feeding apparatus 4 has been pulled out to the position of the distance L2. Therefore, even if the sheet material conveying apparatus 41 exists at any pulling-out position in a range to the position of the distance L2, the developing unit 14 can be moved from the developing apparatus base plate 14M and put onto the slide surface 418A without dropping the developing unit 14 into the gap.

According to the MFP 100 of the embodiment, the multi-feeding apparatus 4 in the state where the developing unit 14 has been supported can be pulled out by the slide rail 423 to the position of the distance L3 where the gap of the width larger than length L1 in the pulling-out direction of the developing unit 14 is formed between the attaching position of the developing unit 14 and the slide surface 418A. Therefore, the sheet material conveying apparatus 41 can be used as a temporary storing location in the outside of the working space or as a cleaning/inspecting position of the developing unit 14.

According to the MFP 100 of the embodiment, the pulling-out path of the developing unit 14 is set under the developer supplementing apparatus 152 for supplementing the developer into the developing unit 14 and the slide rail 423 can pull out the multi-feeding apparatus 4 until the developing unit 14 reaches the outside of the developer supplementing apparatus 152. Therefore, the operator can grasp the second knob 147 and vertically lift up the developing unit 14 without being obstructed by the developer supplementing apparatus 152.

The MFP 100 of the embodiment shown in FIG. 9 has the slide table 419 which is expanded in accordance with the pull-out of the sheet material conveying apparatus 41 and closes the gap which is formed between the attaching position of the developing unit 14 and the slide surface 418A. Therefore, the developer which falls from the developing unit 14 in association with the pull-out of the developing unit 14 is difficult to be dropped from the gap and is difficult to be scattered into the apparatus main body 101 and onto the floor.

The MFP 100 of the embodiment has: the developing unit 14 for developing the electrostatic latent image formed on the surface of the photosensitive drum 12; and the multi-feeding apparatus 4 as one of the arbitrary selecting apparatuses arranged on the side opposite to the photosensitive drum 12 which sandwiches the developing unit 14. The supporting surface of the developing unit 14 whose height coincides with that of the supporting surface of the developing unit 14, that is, the slide surface 418A is formed on the sheet material conveying apparatus 41. The portion in the multi-feeding apparatus 4 in which the slide surface 418A has been formed, that is, the sheet material conveying apparatus 41 can be moved in the horizontal direction in the state where the developing unit 14 has been mounted. Therefore, after completion of the necessary operations, the developing unit 14 can be attached to the original attaching position with high reproducibility without causing a positional deviation or the movement in the erroneous direction which occurs when the developing unit 14 is moved and put on or lifted up.

The multi-feeding apparatus 4 in the embodiment can be attached to the apparatus main body 101 and has: the paper feed tray 40 on which the sheets are stored so that they can be taken out; the sheet material conveying apparatus 41 which is assembled so that it can be separated from the paper feed tray 40, conveys the sheet S picked up from the paper feed tray 40, and sends it to the photosensitive drum 12; and the slide rail 423 which can be attached to the apparatus main body 101 and supports the sheet material conveying apparatus 41 so that it can be horizontally moved. The slide surface 418A on which the developing unit 14 is mounted is formed on the upper surface of the sheet material conveying apparatus 41.

According to the apparatus main body 101 in the embodiment, since attaching screws of the slide table 423 have been prepared for the frame of the apparatus main body 101, the apparatus main body 101 can be used in common for the apparatus with the multi-feeding apparatus 4 and the apparatus without the multi-feeding apparatus.

In the image forming apparatus of the embodiment, the feeding means which has been designed so as to be movable in order to pull out the jammed sheet is used in common for the pulling-out conveyance of the developing means or the storage and holding at the retreat position, so that the members and mechanisms which are exclusively used for the pulling-out of the developing means are unnecessary In other words, the feeding means which inherently becomes an obstacle to the operation for handling or pulling out the developing means is designed to a structure suitable for supporting the developing means in such a manner that it is actively concerned and cooperated with the pulling-out work of the developing means. Therefore, on the contrary, the developing means can be further easily pulled out and stored as compared with the case where there is no feeding means.

Consequently, it is sufficient that the physical strength, experience, knowledge, and skill necessary to pull out the developing means are small. Such a situation that the developing means is hit to the ambient portions and the toner is scattered does not occur. The exchange of the parts and the necessary maintenance work can be executed safely, certainly, and cleanly.

While the present invention has been described with reference to exemplary embodiments, it is to be understood that the invention is not limited to the disclosed exemplary embodiments. The scope of the following claims is to be accorded the broadcast interpretation so as to encompass all such modifications and equivalent structures and functions.

This application claims priority from Japanese Patent Application No. 2005-264782 filed on Sep. 13, 2005, the contents of which is incorporated hereinto by reference.

What is claimed is:

1. An image forming apparatus comprising:

a developing device which develops an electrostatic latent image formed on a surface of an image holding member;

a feeding device which feeds sheets onto which a toner image developed by said developing device is transferred; and a pulling-out member which supports at least a part of said feeding device, wherein said feeding device can be pulled out in a substantially horizontal direction with respect to a main body of the image forming apparatus, and can hold said feeding device at a first position away from said image holding member, wherein said feeding device includes a supporting member which can support said developing device when said developing device is pulled out toward the first position.

2. An apparatus according to claim 1, wherein:

said feeding device further includes a storing member in which sheets are stored so that the sheets can be taken out and a conveying member which conveys the sheets taken out of said storing member, and sends the sheets to said image holding member;

said pulling-out member supports said conveying member so as to be movable to the first position; and said storing member can be pulled out to a position that is further away from the main body of the image forming apparatus relative to a position of said conveying member which has been pulled out to the first position so that a working space is formed between said storing member and said conveying member.

3. An apparatus according to claim 1, wherein:

said supporting member supports said developing device which has substantially horizontally been moved from an attaching position of said supporting member and sent to said feeding device; and a length of travel in the pulling-out direction of said developing device is larger than a width of a gap which is formed between the attaching position and said supporting member when said feeding device has been pulled out to the first position.

4. An apparatus according to claim 3, wherein said pulling-out member supports said feeding device in a state where said developing device has been supported so that said feeding device can be pulled out to a second position where a gap of a width larger than a length of travel in the pulling-out direction of said developing device is formed between the attaching position and said feeding device.

5. An apparatus according to claim 4, wherein a pulling-out path of said developing device is formed under a developer supplementing device for supplementing a developer to said developing device, and said pulling-out member supports said feeding device so that said feeding device can be pulled out until said developing device reaches a position outside of a position of said developer supplementing device with respect to the main body of the image forming apparatus.

6. An apparatus according to claim 1, further comprising developing material drop preventing means which is expanded in accordance with the pulling out of said feeding device and closes a gap which is formed between an attaching position and said feeding device.

7. An image forming apparatus comprising:

an apparatus main body;

a developing device which is arranged on said apparatus main body and develops an electrostatic latent image formed on a surface of an image holding member; and an arbitrary selecting device arranged on a side opposite to said image holding member so as to sandwich said developing device, wherein a supporting surface of said developing device is formed to said arbitrary selecting device, and wherein a portion of said arbitrary selecting device where said supporting surface has been formed is movable in a substantially horizontal direction with respect to said apparatus main body in a state where said developing device pulled-out from said apparatus main body has been set.

8. A feeding device which can be attached to a main body of an image forming apparatus having a developing device, comprising:

a storing member in which sheets are stored so that they can be taken out;

a conveying member which conveys the sheets taken out of said storing member to said apparatus main body; and a pulling-out member attached to the main body and supporting said conveying member so that said conveying member can be moved in a substantially horizontal direction with respect to the main body, wherein a mounting surface of said developing device is formed on an upper surface of said conveying member.

9. An image forming apparatus comprising:

an apparatus main body;

a developing device which is arranged on said apparatus main body and develops an electrostatic latent image formed on a surface of an image holding member and can be pulled out from said apparatus main body;

a sheet conveying device which conveys a sheet onto which the image developed by said developing device is transferred; and a supporting member which is provided for said sheet conveying device and supports said developing device pulled-out from said apparatus main body, wherein said sheet conveying device is movable with respect to said apparatus main body in a pulling-out direction of said developing device.

* * * * *